United States Patent [19]

Kuhr et al.

[11] Patent Number: 4,621,471

[45] Date of Patent: Nov. 11, 1986

[54] BASE TRIM SYSTEM FOR PARTITION CORNERS

[75] Inventors: Albert F. Kuhr, Elk Grove Village; Alan C. Wendt, Barrington, both of Ill.

[73] Assignee: United States Gypsum Company, Chicago, Ill.

[21] Appl. No.: 814,424

[22] Filed: Feb. 6, 1986

Related U.S. Application Data

[62] Division of Ser. No. 694,808, Jan. 25, 1985, Pat. No. 4,569,171.

[51] Int. Cl.[4] ..... E04B 1/00

[52] U.S. Cl. ..... 52/288; 52/242; 52/718.1

[58] Field of Search ..... 52/287, 288, 238.1, 52/242, 716, 717, 718

[56] References Cited

U.S. PATENT DOCUMENTS

| | | | |
|---|---|---|---|
| 3,464,177 | 9/1969 | Amato | 52/287 |
| 3,742,668 | 7/1973 | Oliver | 52/288 |
| 4,104,839 | 8/1978 | Balzer et al. | 52/288 |
| 4,129,971 | 12/1978 | Reusser | 52/288 |
| 4,565,041 | 1/1986 | Wendt | 52/288 |

FOREIGN PATENT DOCUMENTS

| | | | |
|---|---|---|---|
| 557511 | 5/1958 | Canada | 52/288 |

*Primary Examiner*—John E. Murtagh
*Assistant Examiner*—Naoko N. Slack
*Attorney, Agent, or Firm*—Robert M. Didrick; Samuel Kurlandsky; Robert H. Robinson

[57] ABSTRACT

A base trim system for partition corners comprises a base trim and a mounting bracket for the base trim. The base trim piece for the corner of intersecting walls has two upright wings angularly joined at a first edge of each, a recessed flange joined to the opposite edge of each wing, and a planar hook projecting upwardly from each such flange to lie in a plane between the vertical planes of the corresponding wings and flanges. The hook acts as a fastener for an abutting planar base trim piece. The mounting bracket has two planar upright wings, a recessed attachment flange connected to each wing, and an upwardly oriented planar hook extending above each attachment flange. The attachment flanges of this mounting bracket extend laterally beyond the lower flanges of the base trim.

4 Claims, 8 Drawing Figures

BASE TRIM SYSTEM FOR PARTITION CORNERS

This application is a division of application Ser. No. 694,808, filed Jan. 25, 1985, now U.S. Pat. No. 4,569,171, issued Feb. 11, 1986.

This invention relates to movable partitions and more particularly to a base trim for the exterior and interior corners of such partitions. It relates further to a combination of a corner base trim piece and a bracket for mounting the piece on a partition.

A planar base trim and a complementary retainer clip for the straight portions of partitions are taught in a co-pending commonly assigned U.S. patent application having Ser. No. 492,894 and filed on May 9, 1983, the teachings of which are incorporated herein by reference. Although the planar trim may be mitered to form a joint at the partition corners, some contractors have found it rather difficult to do.

Accordingly, it is an object of this invention to provide a preformed base trim for the corners of a movable partition which is simple to install without the use of an adhesive and is simple to remove when the floor plan of a room is to be changed. It is a further object to provide a trim system for corners prone to abuse in which the preformed trim piece is mounted on a matching metal bracket which protects the wallboard of the partition.

These and other objects and advantages which will become apparent from the drawings and detailed description are achieved by an angular trim piece having recessed attachment flanges on opposite lateral edges thereof and planar hooks on the upper edges of the flanges. The hooks support the planar base trim where it abuts the corner trim and the flanges also serve to hide the wall surface when gaps occur between the abutting planar trim and corner trim.

Turning now to the drawings.

Figure 1:
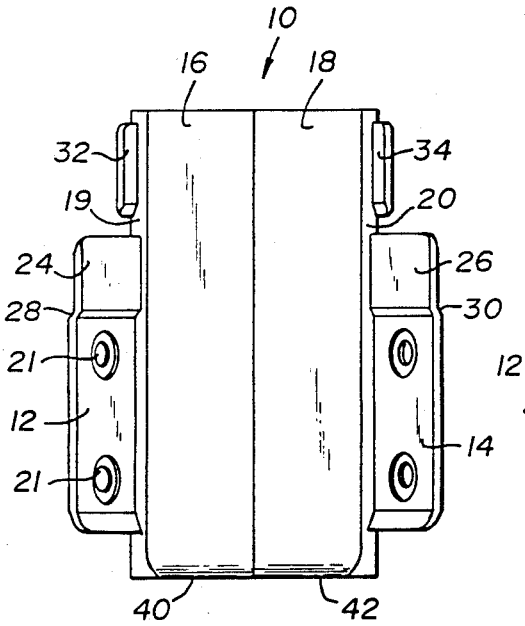
FIG. 1 is a frontal elevational view of a interior corner base trim of this invention.
Figure 2:
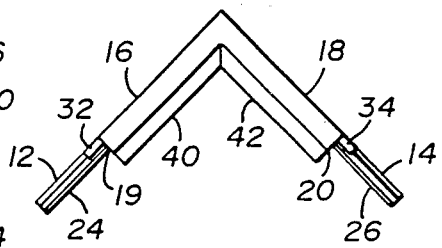
FIG. 2 is a plan view of the base trim of FIG. 1.
Figure 3:
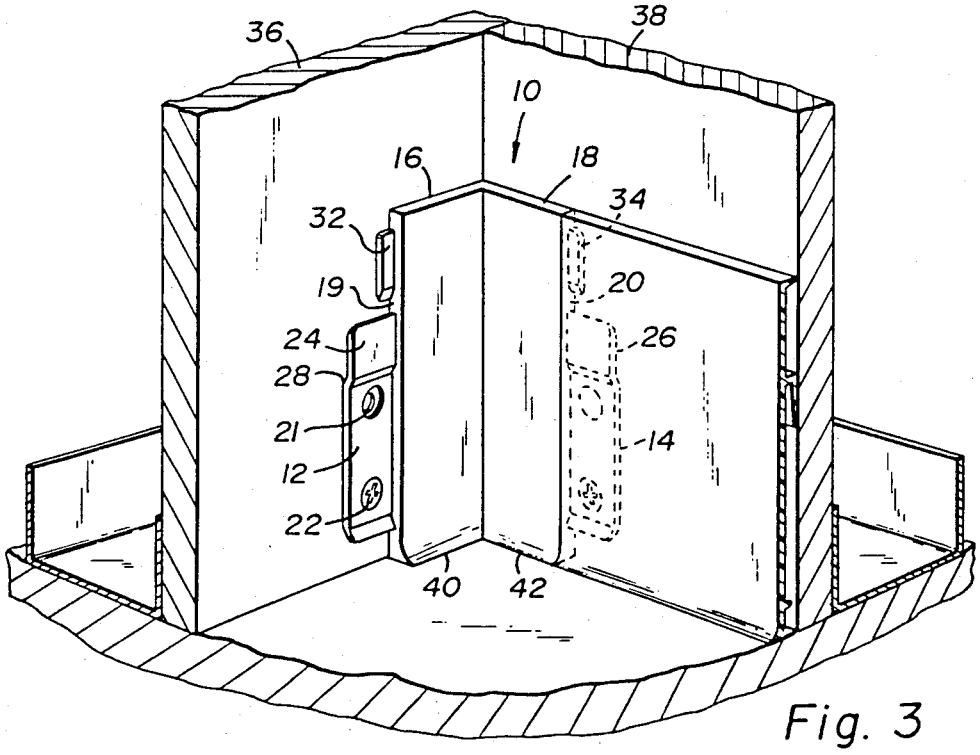
FIG. 3 is a perspective view of an interior corner of a partition showing the relationship between a corner base trim of this invention and a planar base trim.
Figure 4:
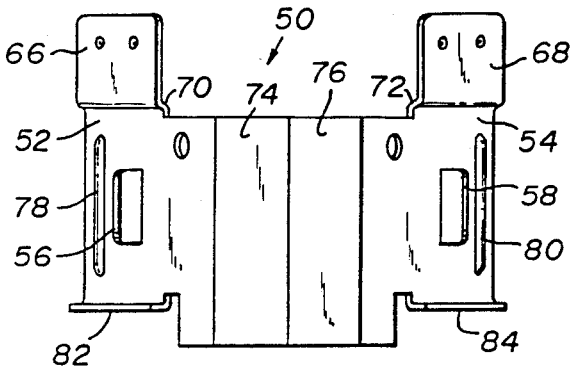
FIG. 4 is a frontal elevational view of a mounting bracket for an exterior corner base trim.
Figure 5:
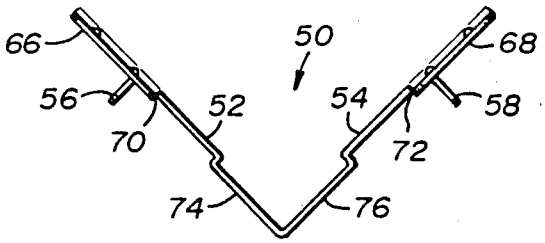
FIG. 5 is a plan view of the bracket of FIG. 4.
Figure 6:
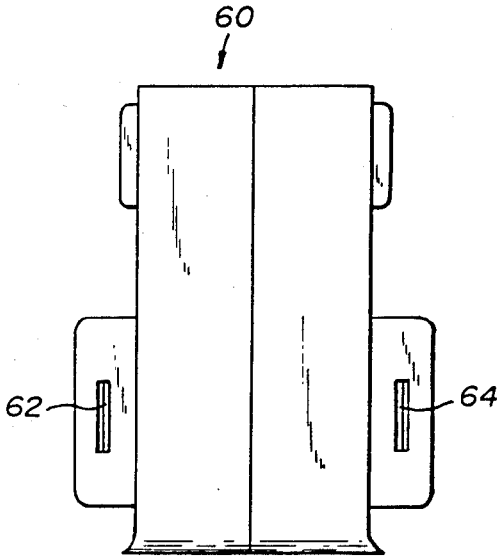
FIG. 6 is a frontal elevational view of a corner base trim to be used in combination with the bracket of FIG. 4.
Figure 7:
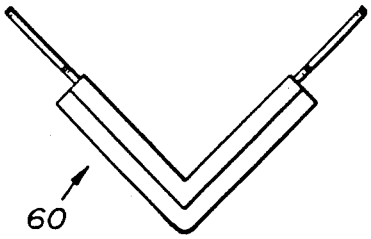
FIG. 7 is a plan view of the base trim of FIG. 6.

In FIGS. 1 and 2, the trim 10 is for an interior corner as shown in FIG. 3. The lower flanges 12 and 14 are connected to the wings 16 and 18, respectively, by the receding webs 19 and 20. The holes 21 are provided to accommodate the screws 22. The hooks 24 and 26 are connected to the upper edges of the flanges 12 and 14, respectively, by the horizontal return webs 28 and 30. The hooks 24 and 26 each lie in a plane parallel to and between the planes of their associated flanges and wings and are thus adapted to support the abutting ends of a planar base trim by engagement with a hanger flange on the back side of the planar trim as shown in FIG. 3. The upper flanges 32 and 34 serve to space the trim 10 away from the walls 36 and 38 uniformly in cooperation with the lower flange and web pairs. The upper and lower flanges also provide fill-in color in gaps created when the corner trim and the planar trim are not carefully abutted. The trim 10 is an integral molding of a pigmented poly-vinyl chloride resin but the flaps 40 and 42 may be relatively more flexible than the wings and flanges so that the flaps can conform to the floor over which they lie.

Figure 8:
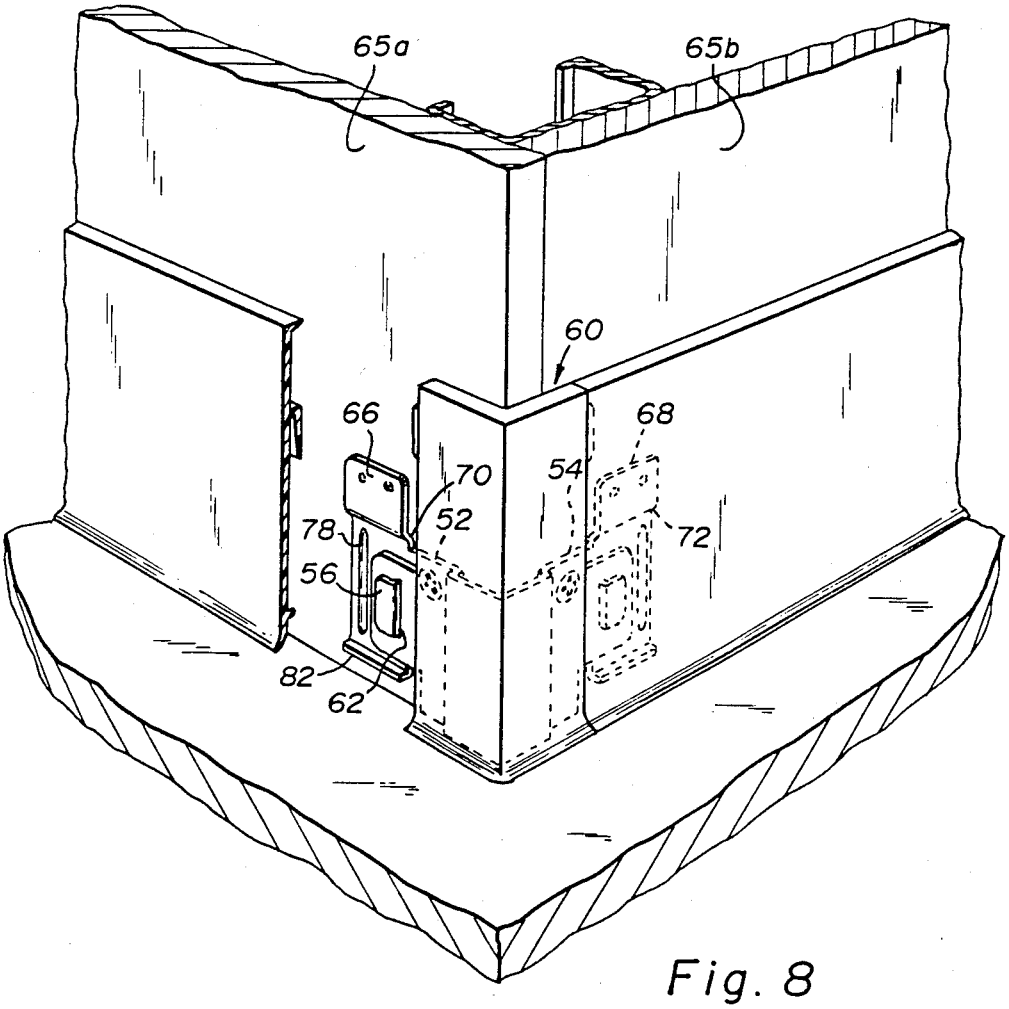
FIG. 8 is a perspective view of an exterior partition corner showing the combination of the bracket of FIG. 4 and the trim of FIG. 6.

The trim pieces in FIGS. 4, 5, 6, and 7 are exterior corner versions of the trim 10. The mounting bracket 50, however, is made of steel or a like material so that it may function as a protector of the wall panels commonly used in movable partitions. The flanges 52 and 54 have struck out tabs 56 and 58 which may be bent outward so that the trim 60 may be mounted on the bracket 50 by passing the tabs through the slots 62 and 64 and bending the tabs back toward the walls 65*a* and 65*b* as shown in FIG. 8. In the combination of the bracket 50 and the trim 60, the hooks 66 and 68 of the bracket 50 serve the same purpose as the hooks 24 and 26 of the trim 10 inasmuch as they are spaced out from the walls 65*a* and 65*b* by the return webs 70 and 72, respectively, so that the hook 66 lies in a plane between the plane of the flange 52 and the wing 74 and the hook 68 is likewise situated with respect to the flange 54 and the wing 76. The ridges 78 and 80 serve to stiffen the flanges 52 and 54 to offset the weakness that may result from the shearing of the metal to form the tabs 56 and 58. The lips 82 and 84 project outward to engage a rib extending along the inner face of a planar base trim which abuts the trim 60.

Instead of the tab and slot connection between the trim and mounting bracket, the trim 60 may be fastened with screws to the framework of the partition along with a mounting bracket having corresponding screw holes.

Although the trim pieces are shown in the drawings to be for right angled corners, the wings may be joined at any angle to accommodate oblique corners of partitions.

It will be understood that the invention is not limited by the details of construction shown and described.

The subject matter claimed is:

1. A base trim system for partition corners comprising a base trim and a mounting bracket for the base trim, said mounting bracket having two planar upright wings angularly joined at a first edge of each, a recessed attachment flange connected to the opposite edge of each wing and extending laterally away from the associated wing, an upwardly oriented planar hook extending above each attachment flange in a plane parallel to but between the vertical planes of the flange and the wing with which it is associated;

said base trim having two planar upright wings angularly joined at a first edge of each and overlying the corresponding wings of the mounting bracket, a recessed lower flange connected to the opposite edge of each trim wing and fastened to the corresponding attachment flange of the mounting bracket in an overlying relationship;

the attachment flanges of the mounting bracket extending laterally beyond the lower flanges of the base trim and being attached to the intersecting walls which form the partition corner.

2. The system of claim 1 wherein the attachment flanges of the mounting bracket each have a tab and the lower flanges of the trim each have a slot through which such a tab passes, the tabs being bent toward the partition to fasten the trim to the bracket.

3. The system of claim 1 wherein the base trim has an upper flange connected to the opposite edge of each wing in the vertical plane of the corresponding lower flange.

4. The system of claim 1 wherein the attachment flanges of the mounting bracket each have a lip projecting outwardly from the lower margin thereof.

* * * * *